United States Patent [19]

Carroll et al.

[11] 4,409,921

[45] Oct. 18, 1983

[54] FLOATING INSPECTION PLATFORM

[75] Inventors: James P. Carroll, Decatur; Paul S. Cary, Florence; Johnny A. McCay, Hartselle, all of Ala.

[73] Assignee: Champion International Corporation, Stamford, Conn.

[21] Appl. No.: 366,473

[22] Filed: Apr. 8, 1982

[51] Int. Cl.[3] ..... B63B 35/58

[52] U.S. Cl. ..... 114/264; 114/352; 441/35

[58] Field of Search ..... 114/74 R, 74 A, 74 T, 114/77 R, 77 A, 343, 346, 352, 353, 364, 61, 39, 263, 264–267; 220/216; 441/35, 47, 40–43, 50, 54

[56] References Cited

U.S. PATENT DOCUMENTS

| | | | |
|---|---|---|---|
| 714,757 | 12/1902 | Strakele | 114/352 |
| 2,071,553 | 2/1937 | McCullam | 220/216 |
| 2,565,369 | 8/1951 | Hamilton | 114/77 R |
| 2,929,080 | 3/1960 | Daily | 441/40 |
| 3,109,183 | 11/1963 | Overmyer | 114/266 |
| 3,473,502 | 10/1969 | Wittkamp | 114/61 |
| 3,968,532 | 7/1976 | Bailey | 114/61 |

FOREIGN PATENT DOCUMENTS

| | | | |
|---|---|---|---|
| 136248 | 12/1919 | United Kingdom | 441/35 |

*Primary Examiner*—Trygve M. Blix
*Assistant Examiner*—Thomas J. Brahan
*Attorney, Agent, or Firm*—Evelyn M. Sommer; William W. Jones; John H. Mulholland

[57] ABSTRACT

A floating platform assembly designed to provide a stable work surface within cylindrical, vertically upward closed vessels which have axially centered obstructions and limited entry space and which vessels are partially filled with a liquid. The platform floats on a plurality of pontoons and includes an annular platform on which persons inspecting the interior of the vessel can stand. The annular configuration of the platform allows it to be assembled within the vessel around the central obstruction. The platform is modular and is assembled in the vessel from a plurality of identical sections. After the inspection of the vessel interior, the platform is disassembled and removed from the vessel through the limited entry space.

4 Claims, 8 Drawing Figures

FLOATING INSPECTION PLATFORM

This invention relates to a floating platform which is adapted for use in inspecting the interior of a liquid-containing vessel which has a limited entry port, such as a manhole or the like. The platform of this invention is primarily adapted for use in the inspection of the interior of wood chip digesters used in the production of wood pulp for the manufacture of paper.

One of the preparatory steps performed in the manufacture of paper from wood is the digesting of debarked wood chips into wood pulp. This step is performed by loading the wood chips into a pressure vessel called a digester and cooking the chips in the digester in a liquor composed mainly of an aqueous solution of sodium hydroxide or of a mixture of sodium hydroxide and sodium sulphide. The liquor may also include other chemicals for certain processing objectives.

The digester is commonly a vertically elongated cylindrical vessel which may be several stories high, and which may be provided with a manhole size access opening at the bottom, and at the top. The access openings are to enable maintenance personnel to enter the digester periodically to inspect its internal condition. A pipe commonly extends through the interior of the digester along its axis, the pipe providing means for charging the digester with the liquor, and for withdrawing the spent liquor from the digester.

As noted above, due to the caustic nature of the liquors used in the digester, the interior of the digester must be periodically inspected by maintenance personnel.

These inspections can present problems due to the size and shape of the digester. In the past, the inspections have been carried out by the use of a steel platform which is sized to the interior of the digester and which is hoisted through the interior of the digester by means of a cable-winch arrangement. The maintenance inspectors stand on the platform as it is raised and lowered through the digester during the inspection. These inspections have also been carried out in the past by using platforms of Styrofoam brand resinous foam secured to a wooden platform on which the maintenance inspectors stand. The platform is raised and lowered through the digester by water which is pumped into and out of the digester. It will be noted that the prior art platforms are jerry-rigged devices which are custom built for use in particular digesters and do not have general applicability for the inspection of digesters in general.

This invention relates to an inspection platform of the floatation type which can be used to inspect the interior of conventional wood chip digesters. The inspection platform of this invention is formed from a plurality of sections which can be readily stored in a compact space when not in use, and which can be erected inside of the digester prior to inspection of the digester. The platform of this invention, when erected, is annular in configuration, so as to take into account the liquor tube which extends along the axis of the digester. The platform is made up of sections which are fitted together inside of the digester to form the annular platform. The sections include a plurality of floatation pontoons which are assembled together to form the floatation portion of the platform. The sections also include a plurality of deck members which are secured to the pontoons and fitted together to form an annular deck upon which the maintenance inspectors and their inspection equipment can stand. A guard rail is preferably disposed about the outer perimeter of the deck. The deck members are each preferably foldable into compact storage configurations. The sections of the platform are taken from storage and inserted into the digester through the lower manhole opening and assembled in the digester. After assembly, the inspectors enter the digester and stand on the platform. The lower manhole is then closed and water is pumped into the digester through the central tube. The upper manhole opening in the top of the digester is left open so that materials can be raised and lowered to the platform. Communication between the inspectors and those outside of the digester is by two-way radio.

It is, therefore, an object of this invention to provide an improved floatation-type inspection platform for visually inspecting the interior of a wood chip digester.

It is an additional objective of this invention to provide an inspection platform of the character described which is constructed of a plurality of sections which can be assembled and disassembled in ready fashion.

It is a further object of this invention to provide an inspection platform of the character described which is annular in configuration.

It is yet another object of this invention to provide an inspection platform of the character described which includes floatation pontoon members and deck members, and which deck members are preferably foldable into compact configurations for storage purposes.

These and other objects and advantages of the invention will become more readily apparent from the following detailed description of a preferred embodiment of the invention when taken in conjunction with the accompanying drawings, in which.

Figure 1:
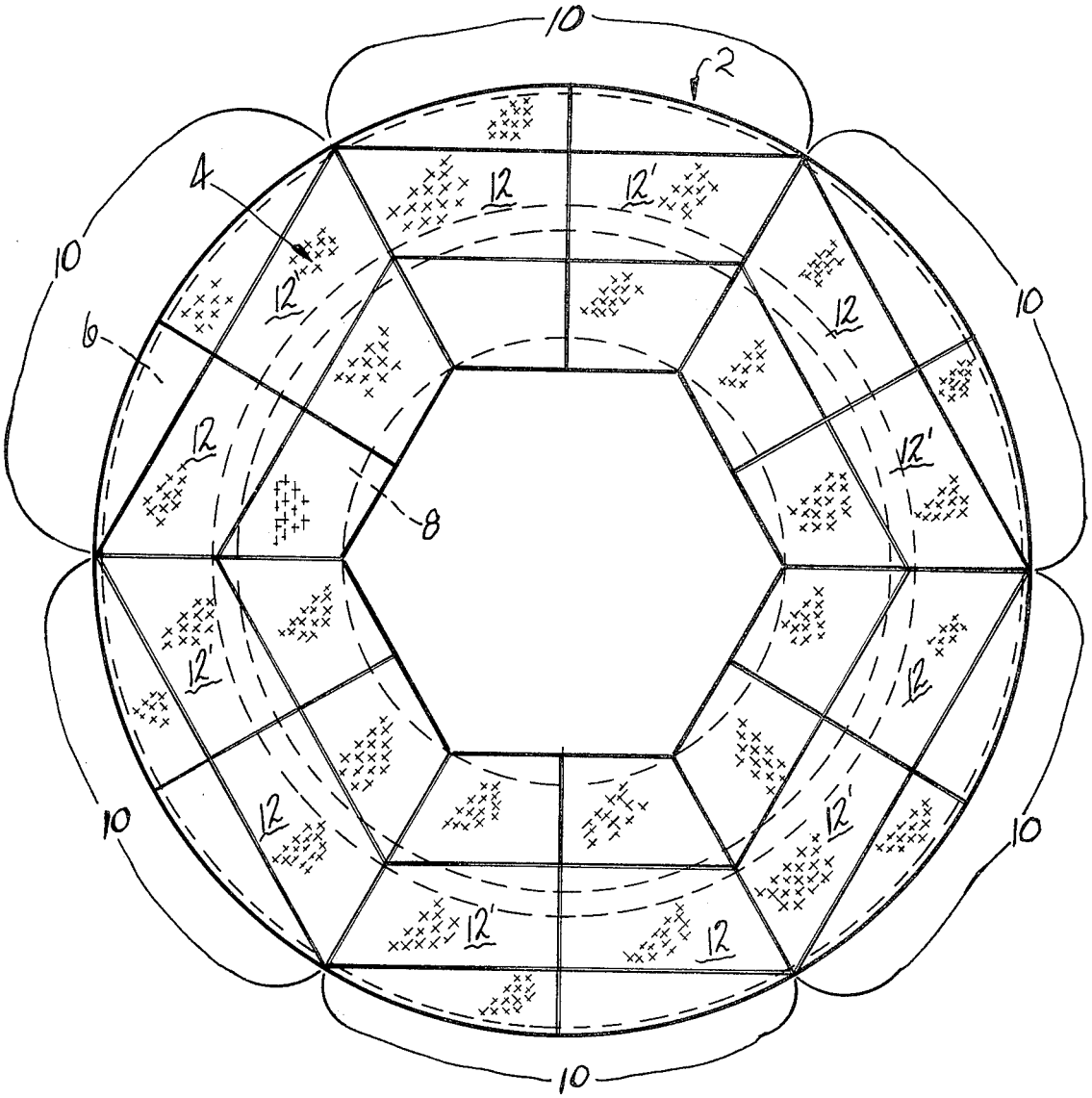
FIG. 1 is a plan view of a preferred embodiment of a platform formed in accordance with this invention.

Referring now to the drawings, there is shown a preferred embodiment of the platform of this invention in FIG. 1. The platform, denoted generally by the numeral 2, is annular in overall configuration, and includes an upper deck portion, denoted generally by the numeral 4, which is supported by a pair of annular pontoon rings, denoted generally by the numerals 6 and 8, 6 being the outer pontoon ring and 8 being the inner pontoon ring. The platform 2 is formed from a plurality of sections 10, there being six of the sections 10 shown in the preferred embodiment of FIG. 1. Each section 10 is composed of two mirror image subsections, 12 and 12'. The deck sections 10 are preferably formed from checkered aluminum plate material.

Figure 2:
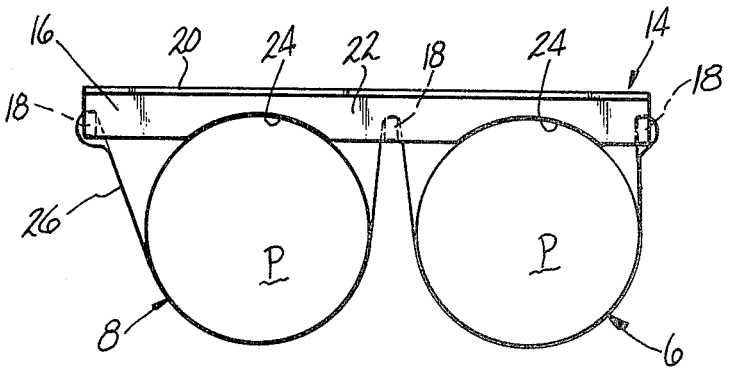
FIG. 2 is a side elevation of a portion of the platform of FIG. 1 showing how the pontoons are attached to the deck braces.

Referring now to FIG. 2, the mode in which the pontoon rings 6 and 8 are attached to the platform 2 is shown. There are provided a total of twelve braces 14 which are positioned with their axis extending radially of the platform 2, there being one brace 14 spanning the joint between each subsection 12 and 12' as viewed in FIG. 1. Each brace 14 is made up of a pair of L-shaped members 16 which are joined together by three spacers 18 which are butt welded to the members 16. The top flanges 20 of the members 16 form a compound upper flange for brace 14. The dependent leg 22 of each member 16 is formed with a pair of arcuate recesses 24 into which the upper curved surface of each pontoon member P is nested. A strap 26 is fastened to each of the distal spacers 18 and is looped around each pontoon P and through the medial spacers 18 so as to lash the pontoons P to the braces 14.

Figure 3:
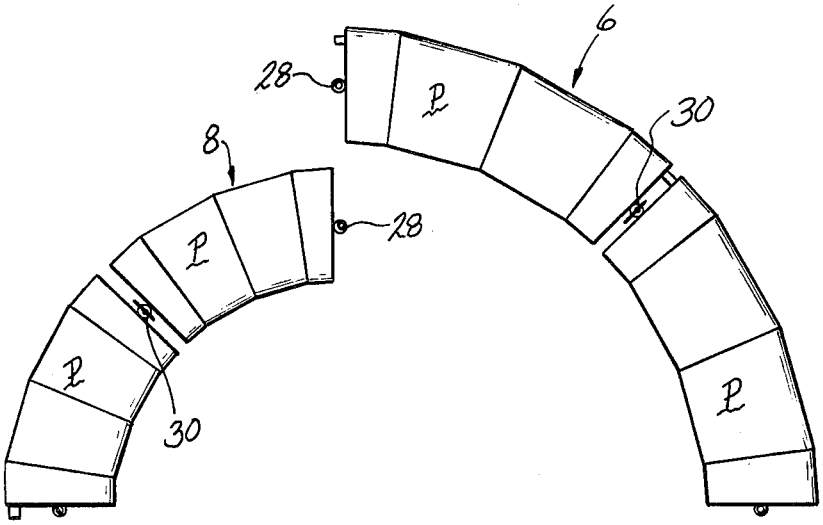
FIG. 3 is a plan view of a portion of the two pontoon rings of the platform showing how the pontoons are configured and arranged.
Figure 5:
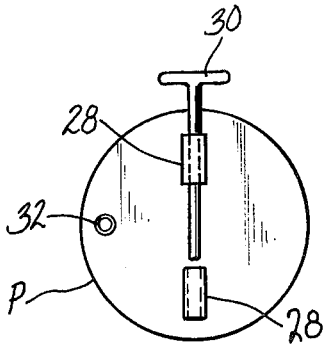
FIGS. 5 and 6 are end elevational views of opposite ends of a pontoon used in the platform.
Figure 6:
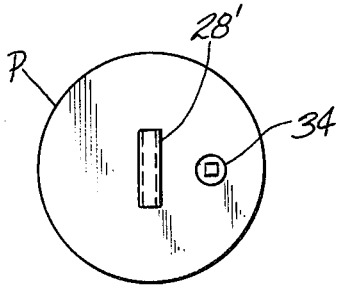

Referring now to FIG. 3, the mode in which the inner and outer pontoon rings, 8 and 6 respectively, are made up of individual pontoons P is shown. Each pontoon P in the ring 6 is identical to each other pontoon in the ring 6, and each pontoon in the ring 8 is identical to each other pontoon in the ring 8. The pontoons P are preferably formed from a plurality of butt welded or brazed aluminum pipe sections which are filled with polyurethane foam. The end walls of the pontoons P are provided with mating hinge loops 28 so that the adjacent pontoons P in each pontoon ring 6 and 8 can be secured together with T-shaped locking pins 30. Referring now to FIGS. 5 and 6, the opposite end walls of a pontoon P are shown. One end wall, shown in FIG. 5, is provided with a pair of spaced apart hinge loops 28, which receive the locking pin 30, and with a projecting pipe 32 secured to the end wall of the pontoon P. The other end wall shown in FIG. 6 is provided with a single central hinge loop 28' and a recessed socket 34. It will be understood that to join two pontoons P together the hinge loop 28' of one is placed between the hinge loops 28 of the other and the pipe 32 is telescoped into the socket 34. The locking pin 30 is then inserted through the aligned hinge loops 28 and 28'. The pontoons P are thus connected together, end to end, to form a pontoon ring.

Figure 7:
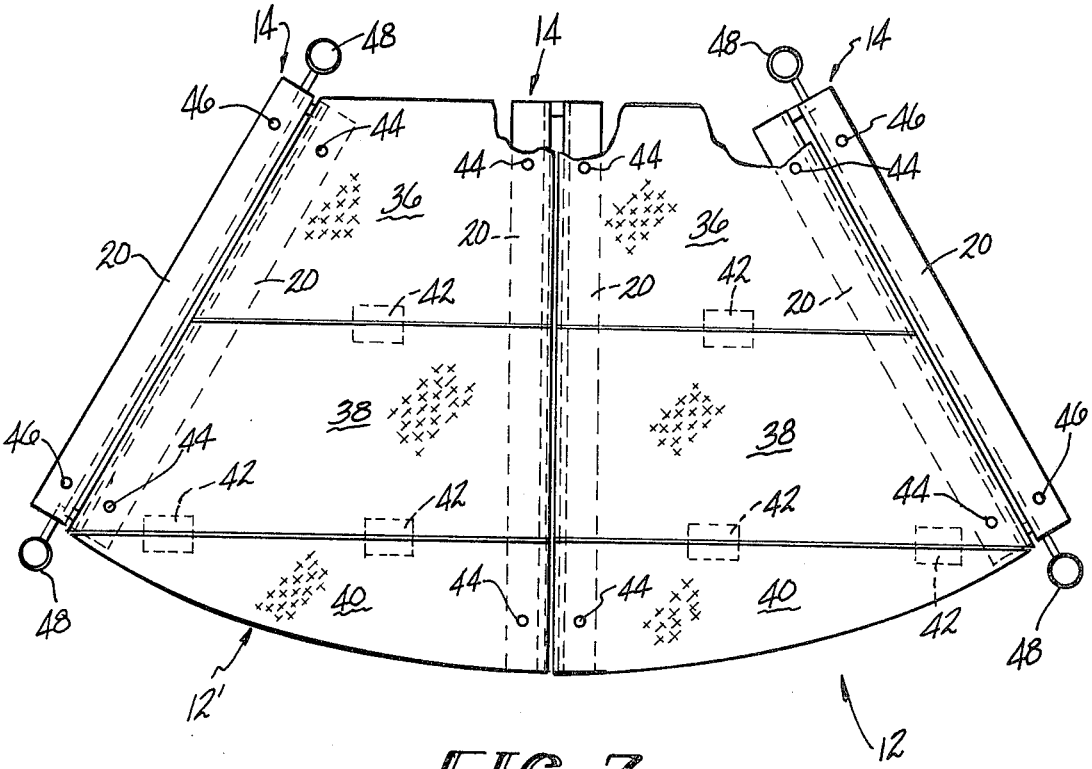
FIG. 7 is a top elevational view of one of the deck sections used to form the deck for the platform.

Once the two pontoon rings 6 and 8 have been assembled, the braces 14 are laid in place and lashed onto the pontoon rings. The deck portion is then secured to the braces 14 as follows. Referring to FIG. 7, it will be noted that each subsection 12 and 12' is made up of three members, an inner member 36, an intermediate member 38, and an outer member 40. The three members 36, 38, and 40 are hingedly joined together by heavy duty aluminum hinges 42 which are welded to the underside of the members 36, 38 and 40. Thus, when the subsections 12 and 12' are not in use and are in storage, the member 40 is pivoted up over and onto the member 38, and the member 36 is pivoted up over and onto the members 38 and 40. Thus the subsections 12 and 12' assume a very compact configuration for storage, and can be opened up for assembly and use. The subsections 12 and 12' are provided with drilled holes 44 which are aligned with drilled holes 46 on the upper flanges 20 of the braces 14. The subsections 12 and 12' are attached to the braces 14 by inserting pins into the aligned holes 44 and 46. The pins are removable when the platform is disassembled. When all of the subsections 12 and 12' have been attached to the braces 14, the platform will appear as shown in FIG. 1.

Figure 4:
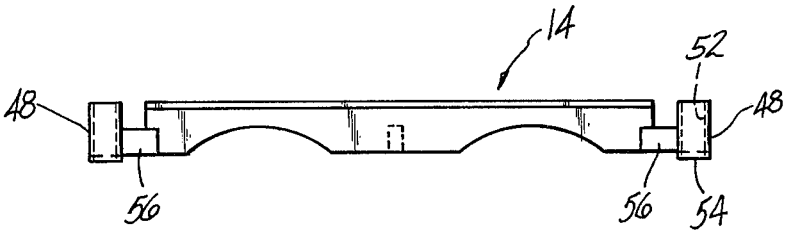
FIG. 4 is an elevational view of a deck brace used in the platform of this invention.
Figure 8:
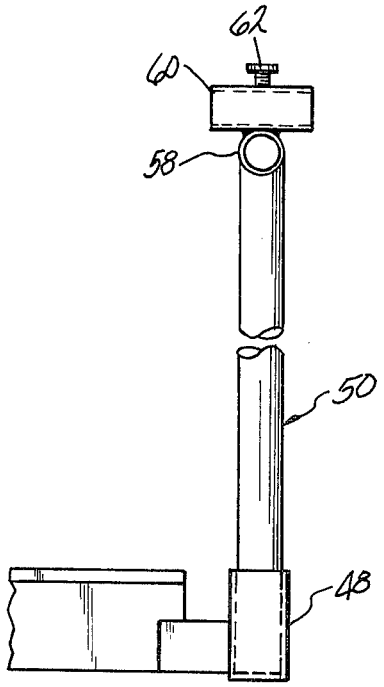
FIG. 8 is a fragmented elevational view of an end portion of a deck brace member showing how the side rail posts are mounted thereon.

It will be noted from FIG. 7 that alternating ones of the braces 14 are provided with post brackets 48 at their inner and outer ends. Reference is made to FIGS. 4 and 8 which illustrate the manner in which the brackets 48 are mounted on the braces 14 and the manner in which the brackets 48 support guard rail posts 50. The brackets 48 are generally cup-shaped members which have an internal bore 52 and a closed bottom 54. They are connected to spacers 56 which are welded to the ends of the braces 14 and to the brackets 48. The guard rail posts 50 are telescoped into the brackets 48 and extend upward therefrom a height sufficient to define a guard rail for persons standing on the platform. An open ended tube 58 having its bore coaligned with the periphery of the platform is welded to the top end of the posts 50. The outer ones of the posts 50 are also provided with a second open ended tube 60 which has its bore extending radially of the platform, which second tube 60 is welded to the top surface of the first tube 58. A safety rope is threaded through the first tubes 58 to provide a safety railing on the inner and outer peripheries of the platform. The second tubes 60 are used to support push poles, which are aluminum poles used to push against the outer wall of the digester to manuever and position the platform radially within the digester. Locking thumb screws 62 are threaded into tapped holes in the second tubes 60 and are used to lock the push poles in place when maintenance of the platform in a particular radial position is desired.

It will be readily appreciated that the platform of this invention provides maximum stability when in the working environment, and can safely support men, machinery and materials when in use. Provision is made for laterally moving the platform in the digester on the floating medium, i.e. water, and for holding the platform in place within the digester while repair work is being performed. The platform can be readily assembled in the digester by passing the relatively compact parts through the manhole and connecting them together inside of the digester. It will be appreciated that the platform will be preassembled, after initial manufacture, outside of the digester, and the various parts will be numbered and the pontoons marked where the braces are to be fitted on the pontoons. This procedure simplifies and speeds up reassembly of the platform each time it is subsequently put into service. It will further be appreciated that, once disassembled, the parts of the platform are all relatively compact and can be stored in a relatively small storage space.

Since many changes and variations of the disclosed embodiment of the invention may be made without departing from the inventive concept, it is not intended to limit the invention otherwise than as required by the appended claims.

What is claimed is:

1. A floating platform adapted for use in inspecting the interior of a liquid-containing vessel, said platform comprising:

(a) a plurality of pontoon members of curvilinear configuration, said pontoon members having end surfaces carrying hinge loop members operable to interfit with cooperating hinge loop members on the end surfaces of adjacent ones of said pontoon members, said pontoon members being arranged to form inner and outer concentric floatation rings for said platform;

(b) removable pin means operable to extend through said interfitted hinge loop members to secure said pontoon members together in the respective inner and outer floatation rings;

(c) a plurality of braces mounted on said floatation rings and extending radially outwardly thereof to interconnect said inner and outer floatation rings together, said braces being equally spaced circumferentially of said floatation rings;

(d) releasable means connecting said braces to said floatation rings;

(e) a plurality of platelike subsections disposed on said braces to form a deck for the platform, said subsections being foldable between a compact storage configuration and an expanded supporting configuration, said subsections having radially extending edge portions overlying said braces whereby each brace supports adjacent radial edges of adjacent ones of said subsections; and (f) pin means interconnecting said braces and said subsections to hold said subsections in place on said braces against lateral movement, and said pin means allowing said subsections to be readily lifted on and off of said braces to assemble and disassemble the platform.

2. The platform of claim 1, wherein said subsections comprise a first set of identical members and a second set of identical members, said second set being the mirror image of said first set.

3. The platform of claim 1, wherein each of said braces comprises a pair of joined L-shaped members having bottom edges which are curvilinearly contoured to engage said pontoon members.

4. The platform of claim 1, wherein said releasable means comprises straps lashing said braces to said pontoon members.

* * * * *

UNITED STATES PATENT AND TRADEMARK OFFICE

CERTIFICATE OF CORRECTION

PATENT NO. : 4,409,921

DATED : October 18, 1983

INVENTOR(S) : James P. Carroll, Paul S. Carey, Johnny A. McCay and Lawrence G. Fendley It is certified that error appears in the above—identified patent and that said Letters Patent is hereby corrected as shown below:

Under "inventors" and after "Johnny A. McCay, Hartselle," insert -- Lawrence G. Fendley, Decatur, --.

Column 3, line 8, after "for" and before "brace" insert the word -- each --.

Column 4, line 19, delete "manuever" and insert in lieu thereof -- maneuver --.

Signed and Sealed this

Tenth Day of July 1984

[SEAL]

*Attest:*

GERALD J. MOSSINGHOFF

*Attesting Officer*

*Commissioner of Patents and Trademarks*